US008991483B2

(12) United States Patent
Irani

(10) Patent No.: US 8,991,483 B2
(45) **Date of Patent: *Mar. 31, 2015**

(54) APPARATUS AND METHOD FOR REPRESENTATIVE FLUID SAMPLING

(76) Inventor: Cyrus Aspi Irani, Houston, TX (US)

( * ) Notice: Subject to any disclaimer, the term of this patent is extended or adjusted under 35 U.S.C. 154(b) by 44 days.

This patent is subject to a terminal disclaimer.

(21) Appl. No.: 13/507,801

(22) Filed: Jul. 30, 2012

(65) Prior Publication Data

US 2014/0027105 A1 Jan. 30, 2014

(51) Int. Cl.
*E21B 49/08* (2006.01)

(52) U.S. Cl.
CPC ..... *E21B 49/08* (2013.01); *E21B 49/082* (2013.01)
USPC ..... 166/66.4; 73/152.23; 73/152.28

(58) Field of Classification Search
CPC ..... E21B 49/081; E21B 49/082
USPC ..... 166/264; 73/152.23, 152.28
See application file for complete search history.

(56) References Cited

U.S. PATENT DOCUMENTS

| | | | | |
|---|---|---|---|---|
| 3,336,925 | A * | 8/1967 | Thompson, III | 604/155 |
| 3,677,081 | A * | 7/1972 | Newton et al. | 73/152.24 |
| 5,240,072 | A * | 8/1993 | Schultz et al. | 166/169 |
| 5,377,755 | A | 1/1995 | Michaels et al. | |
| 7,197,923 | B1 | 4/2007 | Wright et al. | |
| 7,472,589 | B2 | 1/2009 | Irani et al. | |
| 7,596,995 | B2 | 10/2009 | Irani et al. | |
| 7,762,130 | B2 | 7/2010 | Irani et al. | |
| 7,926,342 | B2 | 4/2011 | Irani et al. | |
| 7,946,166 | B2 | 5/2011 | Irani et al. | |
| 7,950,277 | B2 | 5/2011 | Irani et al. | |
| 2004/0089448 | A1 | 5/2004 | Difoggio | |
| 2004/0129070 | A1 | 7/2004 | Bolze et al. | |
| 2006/0054323 | A1 | 3/2006 | Grant et al. | |
| 2008/0078581 | A1 | 4/2008 | Goodwin et al. | |
| 2008/0245569 | A1 | 10/2008 | Nold et al. | |
| 2009/0194279 | A1 | 8/2009 | Tarvin et al. | |
| 2010/0116493 | A1 | 5/2010 | Irani et al. | |
| 2010/0282516 | A1* | 11/2010 | Buchanan et al. | 175/58 |
| 2013/0291669 | A1* | 11/2013 | Hwu et al. | 74/89.23 |

FOREIGN PATENT DOCUMENTS

WO 201108586 A2 7/2011

* cited by examiner

*Primary Examiner* — Giovanna Wright
*Assistant Examiner* — Richard Alker

(57) ABSTRACT

Apparatus and method for collecting and preserving in representative condition a fluid sample from a reservoir which comprises: positioning a sample receptacle in the vicinity of a subterranean zone to be sampled, allowing or causing the sample to first flow into the sample receptacle, wherein the movement of the sample into the sample receptacle is restricted by the movement of a sampling piston, and wherein the movement of the sampling piston is further controlled by the rotation of an electrical motor connected to the sample piston such that the rotation of the electric motor translates to lateral movement of the sample piston, the lateral movement of the sample piston in turn allowing sample to enter the sample receptacle, and wherein once an adequate volume of sample has been collected, reversing the direction of the electrical motor will serve to cause the sample piston to exert pressure on the collected sample.

12 Claims, 6 Drawing Sheets

APPARATUS AND METHOD FOR REPRESENTATIVE FLUID SAMPLING

TECHNICAL FIELD OF THE INVENTION

This invention relates, in general, to equipment utilized in conjunction with operations performed in relation to subterranean wells and, in particular, to a sampler for collecting and recovering a representative fluid sample from a subterranean formation of interest.

BACKGROUND OF THE INVENTION

Without limiting the scope of the present invention, its background will be described in relation to exploratory subterranean well operations, as an example.

As used herein, the words "comprise", "have", "include", and all grammatical variations thereof are each intended to have an open, non-limiting meaning that does not exclude additional elements, steps, or embodiments. Furthermore, it should be understood that as used herein, "first", "second", "third", etc. are arbitrarily assigned and are merely intended to differentiate between two or more elements, devices, embodiments, etc., as the case may be, and does not indicated a specific sequence, nor should be viewed as a limiting sequence. Furthermore, it is to be understood that the mere use of the term "first" does not automatically imply that it should be followed by a "second" or for that matter a "second by a "third".

As used herein, a "fluid" is a substance having a continuous phase that tends to flow and to confirm to the boundaries of the vessel containing it. A fluid can display the properties of a liquid or a gas, depending on where, based on its composition, temperature and pressure, it falls on the gas-liquid continuum.

From simple beginnings, the search for oil reserves has moved into more remote locations and more technically demanding reservoirs and environments. Exploratory wells are often drilled with the goal of finding new hydrocarbon reserves, identifying the nature of the reserves, and then verifying their economic viability. Consequently, after a well has been drilled and underground hydrocarbon bearing strata have been identified, it is desirable to determine the physical characteristics of the strata in question and also the chemical characteristics of the hydrocarbon in place. The physical characteristics provide invaluable clues as to the extent of the reservoir and how fast it can be made to produce its hydrocarbon content. The chemical characteristics are invaluable in defining the monetary value of the hydrocarbon reserves as also the best mechanism by which the recovered reserves can be handled and further processed. Both the physical and chemical characteristics are invaluable pieces of information for defining the monetary value that can be assigned to a prospective discovery.

Numerous pieces of equipment and methodologies are available and well known to those active in the industry for determining the physical properties of a reservoir. These include the extensive suite of tools available during Measurement while Drilling (MWD) and Logging While Drilling (LWD) operation, Wireline Formation Testing (WFT) operations, Production Logging (PL) operation, and Surface Well Testing (SWT) operations including methodologies such as pressure drawdown testing, gamma-ray logging, neutron density logging, MRI logging, etc. For the sake of brevity these will not be further discussed, though an absence to do so should not be viewed as a limitation to this disclosure.

A detailed understanding of the reservoir fluid including its chemical description may be viewed as perhaps the most significant aspect of any well test operation. A sample of the reservoir fluid is invaluable for undertaking a detailed laboratory PVT analysis, where the initials PVT stand for Pressure, Volume, and Temperature. A representative reservoir sample is also crucial for generating a detailed chemical analysis of the hydrocarbon phase. For these and many other reasons it should be readily apparent to those familiar with the oil industry that collecting and recovering a representative sample of reservoir fluid is a crucial first step in defining the economic viability of a newly discovered hydrocarbon reservoir.

There are a number of opportunities during the exploratory and production cycle when a reservoir sample can be collected. Recent technological developments have made it possible for hydrocarbon samples to be collected as early as the drilling phase. During drilling operations samples can be collected in samplers associated with the drill string. After the conclusion of the drilling phase and while the drilled borehole is still an open hole, namely exposed formation rock, samples can be collected during traditional Wireline Formation Testing (WFT) operations. During WFT a number of tools directed at delivering a better understanding of the physical and chemical nature of the reservoir are introduced into the borehole via wireline. Included in this tool string is a set of samplers for collecting bottomhole samples.

Once casing is set and the openhole is cemented, a Drill Stem Test or DST can be undertaken. During a DST operation samples can be collected on pipe or tubing by incorporating carriers specifically designed for carrying a multiplicity of samplers from the surface to the subterranean zone of interest on the work string. A cased hole environment also affords numerous opportunities to run a set of production logging tools on e-line or wireline, which offers yet another excellent opportunity to collect samples of the reservoir fluids.

The sample collecting process itself is complicated and requires a number of distinct and necessary steps. First a subterranean zone of interest needs to be identified that would warrant the expense of undertaking a sampling operation. Next, a sample collection devise has to brought adjacent to or in the vicinity of the subterranean zone of interest. With the sampler at location some mechanism is needed to trigger the sampler at the correct instance during some specific static or flow period appropriate to the testing being undertaken of the subterranean zone of interest. Once the sampler is triggered the sample should be collected in a controlled fashion so as to minimize the possibility of the sample flashing two phase. Once the sample collection has been completed, the sample has to be locked in place in the sampler, and simultaneously a high pressure charge of gas, usually nitrogen, is released against the sample to exert pressure on the sample and keep it single phase during recovery to the surface. At the surface the sample is usually transferred, again at high temperature and pressure, into long term storage bottles.

Almost exclusively, a sample is collected ahead of a moving piston located in a tubular section. Preserving the integrity of the sample during the collection phase requires that the movement of the piston be slowed down to prevent the sample from flashing to two phases the instant the sample's tubular section is exposed to the pressurized fluid phase to be sampled. Slowing the movement of the sample collecting piston is most easily accomplished by the simple expediency of incorporating some non-interacting fluid, usually referred to as a displacement fluid, on the backside of the piston, namely the side opposite to where the sample will collect. As a consequence, as the sample enters the tubular section on one side of the sample piston causing it to be laterally displaced, this lateral movement of the piston will result in a corresponding lateral displacement of the displacement fluid. If the lateral displacement of the displacement fluid is further constrained by forcing it through a very fine constriction or choke, then the resulting very slow movement of the piston due to the restriction of the movement of the displacement fluid is successful in delivering a single phase sample where flashing has been mostly eliminated. Furthermore, it should be readily obvious to one familiar with the art, that the very presence of the displacement fluid will require that the sampler be equipped with some low pressure dump chamber into which the displacement fluid can be ejected while the sample is being collected, and where the displacement fluid will stay stored during the entire sample collection, recovery to the surface, and subsequent storage until such time that the sample is transferred out of the sampler for further analysis.

Once the sample has been collected, it is necessary that it be immediately brought in contact with a high pressure nitrogen charge in order to bring the sample pressure up to some desirable value necessary for the sample to stay single phase during recovery to the surface and subsequent transportation and storage. Consequently, each sampler must be connected to a high pressure nitrogen source, to which end each sampler can have its own nitrogen source, which is by far the more prevalent design, or, as is seen in some very unique cases, there can be a common nitrogen source for more than one, or even all the samplers. Irrespective of the exact design, it is imperative that the pressure and volume of the nitrogen source be such that it will successfully maintain the sample pressure at least 2000 psi above and preferably even higher than the pressure at which the sample was collected, and maintain this high pressure during the entire subsequent history of the sample.

To reiterate, a successful sampling operation as conventionally undertaken requires some device rated for high pressure and temperature service which is equipped with a plurality of associated chambers and mechanisms such that when said device is brought alongside a subterranean formation of interest and triggered or activated, it will allow the fluid contained in the subterranean formation of interest to enter and gather in the appropriate receptacle. Furthermore, the entry of the said reservoir fluid into the said receptacle is deliberately controlled by the slow drainage of a displacement fluid from the receptacle receiving the sample into some immediately or closely associated chamber specifically included for the purpose of receiving the displacement fluid. The controlled movement of the displacement fluid is most effectively implemented by forcing the displacement fluid to flow through a restrictive choke as it transitions between the two afore mentioned chambers.

Once the sample has been collected it is necessary that the sample be locked in place to trap it so it is contained for further transportation and handling. Simultaneously, a source of high pressure gas, preferably nitrogen, contained in a chamber either adjoining the sample receptacle or in close proximity to the sample receptacle, is brought in indirect communication with the collected sample so as to take the pressure of the sample at least 2000 psi above the pressure at which it was collected and keep it at this high pressure during the subsequent recovery to the surface.

All of this requires a number of intricate parts that must work in precise unison if the sampling step is to be successful. Consequently, it should be obvious to one well versed in the sampling art that there is a need for a sampler of simpler design that is easier and safer to operate and would deliver a more reliable performance than is presently available.

SUMMARY OF THE INVENTION

The present invention disclosed herein is directed to a sampling apparatus for collecting and preserving a representative sample of a subterranean reservoir fluid. Additionally, the proposed design has the flexibility and versatility to function effectively in numerous subterranean environments and applications including open hole and cased hole situations. Furthermore, the proposed design has the flexibility and versatility to function effectively when conveyed to the subterranean formation of interest by any of a number of means. The means of conveyance may include slickline, wireline, e-line, coiled tubing, pipe, tubing, etc. The proposed design also has the flexibility to deliver a representative sample irrespective of the fluid type encountered.

Additionally, the proposed design is unique in that it eliminates the need for the displacement fluid and also a high pressure nitrogen source resulting in a much simpler and more compact device. Furthermore, the uniqueness of the design delivers samplers with much higher recovery pressures relative to the more conventional design using a nitrogen charge.

To achieve the above stated objectives the method of the present invention will incorporate an appropriately sized electrical motor into the body of the sampler. The power needed to run the electrical motor will come from either a battery pack or an attached electrical cable if the sampling operation is being undertaken using a wireline or e-line. The electrical motor in turn will drive a screw, either directly or through the agency of a set of gears, the screw being connected at one end to the motor/gear assembly and at the other to a sample piston that will slide in the tubular section which is the receptacle for the sample. The screw will also be positioned laterally within a fixed sleeve with a ball screw centered in it through which the screw itself will pass such that the rotation of the screw in either direction will cause a corresponding lateral movement of the screw through the fixed sleeve containing the ball screw. The lateral movement of the screw in the sleeve will result in a lateral movement of the drive motor and the sample piston attached to the screw. The lateral movement of the piston can thus be used to exert a desired pressure on the sample contained in the tubular section ahead of the sample piston. By using the electric motor and attached screw to drive the sample piston through all phases of the sampling process, all the varied steps and ancillary components associated with a conventional sampler, like the need for a displacement fluid, metering valve, dump chamber, nitrogen charge, etc. are eliminated.

Even though a ball screw is specifically mentioned, it should in no way be construed as a limitation. Actually, any mechanical linear actuator that translates rotational motion generated in the screw by virtue of the working of the electrical motor, with or without the agency of a gear box, to linear motion of the screw with minimal frictional losses will be adequate for the intended purpose. A lead screw, also known as power screw or translational screw could be equally adequate for the intended purpose. Whereas a ball screw is recognized as having the lowest friction, a lead screw with square threads would also be effective while minimizing friction. Other alternatives without in any way limiting the scope of the invention would be Acme threads which are less efficient than square threads because of greater friction.

Additionally, even though the above example discusses a configuration in which the electric motor, screw, and piston move laterally as a single connected unit, it would be obvious to one versed in the art that any other configuration would be equally feasible. Thus, and as an example only, it would be entirely feasible for the motor to be rigidly and unmovably confined, while the turning of the screw can still be used to move the piston in the desired direction by means of a different arrangement to be discussed below for translating rotational to lateral movement. For the purpose of the rest of this discussion it can be presumed that any and all elements, components, and procedures related to the sampling process will be equally applicable to either of the above mentioned configurations, namely where the electrical motor is allowed to move in the exercising of its function, or held rigidly while doing the same.

Associated with the electric motor and in electrical communication with it is a programmable electronic controller. The purpose of the programmable electronic controller is to provide instructions to the electrical motor to define exactly how and when the motor is to function. For example, instructions provided either as input at the surface and stored in memory associated with the programmable electronic controller before start of sampling operations, or transmitted during sampling operations either via an optical cable, or an electrical cable, or as an acoustic signal from the surface to an appropriate receiver in the programmable electronic controller, would provide instructions on the direction, speed and duration that the electrical motor should run in order to provide some necessary function associated with the sampling process.

In operation, the sampler would be positioned at the subterranean formation of interest via one of the methods of conveyances mentioned above. When so positioned the sampler is in the start position with the sample piston at the far end of the tubular section that the sample will collect in. Depending on the method of conveyance it might be necessary to instruct the programmable controller while still at the surface to undertake a specific set of actions in a specific time sequence starting after some preset and predetermined period of time. For example, just before the sampler is attached to the method of conveyance, a start timer may be set with a time delay of say, and as an example only, ten hours. Accordingly, when ten hours have transpired the sampler operation will be initiated, starting with a set of actions needed to begin collecting a sample.

As part of this start operation some passageway between the receptacle where the sample will collect, and the fluid to be sampled present in the external surroundings of the sampler, will be opened so that sample is now free to flow into the sampler. However, sample cannot flow into the sampler unless the sample piston starts to move, which is achieved by instructing the electric motor via the electronic controller to turn in a direction appropriate to the movement of the screw, and consequently, the piston, so as to open a volume in the tubular element on the unattached side of the piston into which sample can flow.

The speed of the electric motor can be controlled such that the rate of movement of the sample piston is such as to assure that no flashing of the sample takes place during capture as required by the constraints of single phase sampling. Another option might be to move the sample piston in very short bursts so as to again limit the volume expansion of the sample chamber during sampling. Yet another option would be to move the piston in a short burst in a direction appropriate to collecting a sample, following which step the direction of the piston can be reversed to compress the collected sample. Such a unique flexibility in motion is not available with any other sample collecting tool and makes this design invaluable for a range of applications including heavy oils at one extreme and wet condensates at the other.

This movement of the piston and associated sample collection action will continue until the piston has traversed a specified distance, or concurrently, the electric motor has gone through a specified number of revolutions, at which time the further lateral movement of the sample piston is curtailed and a sample is considered collected. At such specified moment as when the sample collecting step has ended, the direction of the electric motor can be reversed so that the direction of rotation of the screw and the subsequent lateral movement of the sample piston is now directed at compressing the sample in the sample chamber.

This reversed direction of the motor will cause the pressure of the collected sample to exceed the external pressure, or the original pressure at which it was collected, and this differential pressure can be used to activate any of a number of mechanisms that will effectively lock the sample in place. With the sample locked in place, continued movement of the sample piston due to continued rotation of the electric motor can be used to pressurize the sample to any desired value above its collected value such that its single phase recovery is assured. The desired single phase recovery pressure can be set at the surface and monitored during the time the sample is being collected by virtue of pressure sensors set in the sample side face of the sample piston and which can be used to continuously monitor the pressure of the collected sample.

The present invention disclosed herein is directed to a sampling apparatus for collecting and preserving a representative sample of a subterranean reservoir fluid. Additionally, the proposed design has the flexibility and versatility to function effectively in numerous subterranean environments and applications including open hole and cased hole situations. The present design is also very effective for the capture of all types of hydrocarbon systems ranging from highly viscous low API oils to very compressible gases. Furthermore, the proposed design has the flexibility and versatility to function effectively when conveyed to the subterranean formation of interest by any of a number of means. The means of conveyance may include slickline, wireline, coiled tubing, pipe, etc.

BRIEF DESCRIPTION OF THE DRAWINGS

For a more thorough understanding of the components, features and advantages of the present invention, reference is now made to the detailed description of the invention along with the accompanying figures in which corresponding numerals in the different figures refer to corresponding parts and in which.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. Obvious variations on these exemplary embodiments will be readily apparent to others well versed in the art and are hereby incorporated into this disclosure by virtue of their obviousness. The depicted and described embodiments of this disclosure are examples only, and not exhaustive of the scope of the disclosure.

DETAILED DESCRIPTION OF THE INVENTION

The making and using of various embodiments of the present invention are discussed in some detail below. However, it should be appreciated that the present invention provides many applicable and synergistic innovative opportunities which can be embodied in a wide variety of specific contexts. The specific embodiments discussed herein are merely illustrative of specific ways to make and use the invention, and do not delimit the scope of the present invention. Consequently, the following embodiments are presented only to facilitate a better understanding of the proposed invention, embodiments of which might be applicable to vertical, horizontal, deviated or otherwise nonlinear wellbores in any type of subterranean formation. These embodiments may be applicable to exploratory wells, test wells, production wells, or injection wells.

Figure 1:
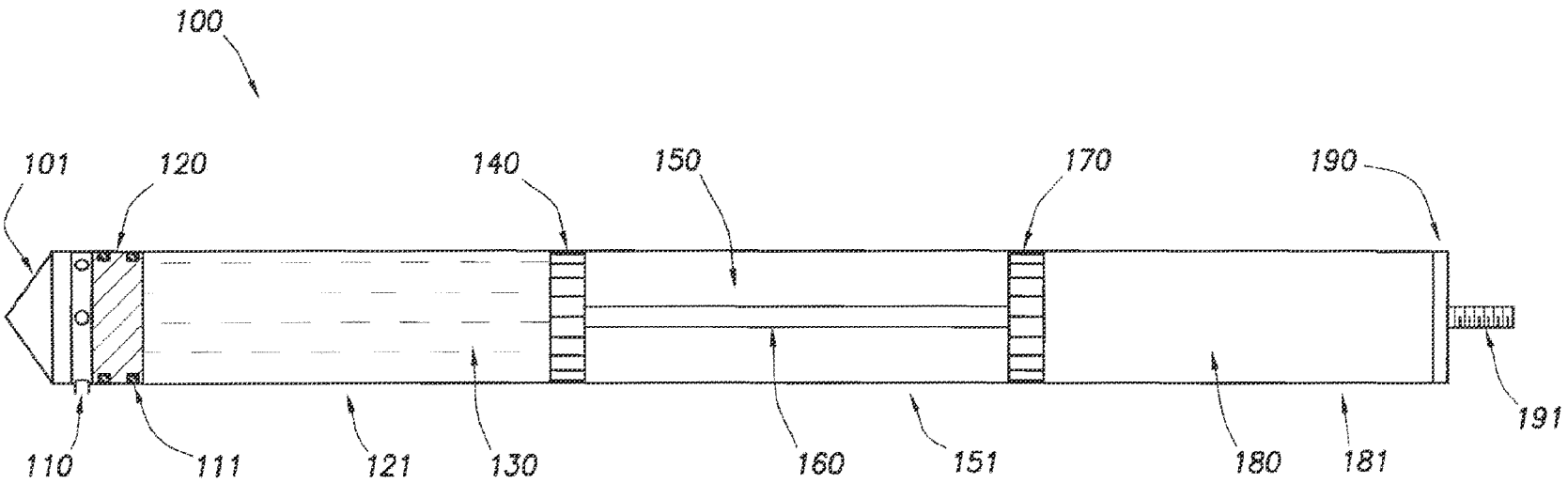
FIG. 1 (PRIOR ART)
FIG. 1 is a schematic illustration of a conventional sampler designed to facilitate the capture and recovery of a representative sample of fluid from a subterranean formation for further handling and analysis.

Referring initially to FIG. 1, therein is depicted a typical, conventional, commercially available sampler with the designation 100, operable to collect and retain a representative fluid sample from a subterranean zone of interest. The subterranean zone of interest can be considered to be a repository of some fluid type, which could be a hydrocarbon species in the form of oil or gas, or mixtures of the two, or even water, or mixtures of hydrocarbon oil, gas and water. Without in any way limiting the scope of the invention, the phases most often encountered during well testing in oil field situations could be solids of both organic and inorganic nature, water, hydrocarbon liquid, and hydrocarbon gas. As a rule, use is made of accessories such as tubing, piping, wireline, slickline, valves, sensors, samplers etc. to access a subterranean zone of interest so that its properties can be evaluated. Part of this evaluation step includes positioning a sampler or a plurality of samplers alongside a single or multiphase mixture that represents a reservoir fluid that is desired to be collected. When sampler and fluid to be sampled are properly positioned with reference to each other, some internal pre-set or external stimulus or signal is provided to activate the sampler and start the sampling process.

A traditional sampler usually comprises a tubular section in which the desired sample accumulates, and additional tubular sections that help to achieve the sampler's objectives. Even though the tubular section is circular in form, there is no reason why it could not be oval, or square, or even rectangular, other than the fact that the tubular sections are easiest to machine, fabricate and manipulate. For convenience, and without in any way limiting the scope of this invention, the tubular section will be considered to be circular. The first tubular section, identified as 121 is the section into which the sample of interest will flow by lateral movement of the sample piston 120 to the right. An effective hydraulic seal is present across the piston 120 to eliminate cross contamination of the sample being collected to the left of it and the displacement fluid to the right of it, and is achieved through the use of elastomer seals 111, a set of which are portrayed. Movement of the piston will move displacement fluid 130 from tubular section 121 through passage 160 and into tubular section 181. The third tubular section 151 contains the high pressure nitrogen, 150, needed to maintain the collected sample single phase during recovery to the surface and subsequent transportation, storage and eventual transfer.

With continued reference to FIG. 1, the front or leading piece as defined by viewing the sampler from left to right and indentified in the figure as 101, acts as the required trigger which responds either to a pre-set or to some subsequent external or internal stimulus or signal so that the sample collection process can be initiated. The actual trigger can take many forms, be differently positioned, and have numerous means of activation, so that the offered generic description is merely an example of a first step needed to start the sampling process and is not meant in any way to limit the scope of this disclosure.

As part of the sampling process the fluid to be sampled can now freely enter the openings in the sampler identified as 110 and start filling the sampler. These openings can also take many forms and be variously located without in any way limiting the scope of this disclosure. For example, even though the openings are portrayed along the circumference of tubular element 121, the opening could as easily be singular and in front of the sampler indicated by the trigger component 101. Suffice it to say that there is either a singular or multiple set of openings in the sampler, usually at the leading edge, which connect via some passage to a point just in front of the sample piston identified as 120, such that when the sampler is triggered to start collecting a sample, the fluid to be sampled and which is usually surrounding or in communication with the sampler, is brought in contact with the space in front of piston 120, that is between the sample piston 120 and the trigger section 101 so that sample collection can commence.

The components identified as 140, 170, and 190 are distinct elements that provide demarcation between the three tubular sections discussed above and also contain other functions as discussed in some detail below, all of which are needed to deliver the proper and complete sampling function. The piece marked as 191 is usually some generic connector that allows the sampler to either be attached to some other sampler as in a sequence of samplers, or to a larger carrier that is carrying a number of samplers, or to some other means of conveyance of the sampler, either slickline, wireline, coiled tubing, or electrically powered tractor motor, to its subterranean location.

As the fluid to be sampled enters the sampler it first encounters the sample piston identified as 120. In order to minimize the possibility for flashing the sample and making it go two phase, the sample piston 120 is backed up by the displacement fluid 130. The displacement fluid 130 can be any convenient fluid whose restricted movement through a metering section slows the movement of the sample piston and does not allow the sample to flash. The metering section is invariably a choke of sorts or some similar restriction that limits the rate at which the displacement fluid can be moved through it. This choke or restriction would usually be positioned as a component of the element identified as 140, usually in advance of or in association with the passage marked as 160. The passage marked as 160 serves to take the displacement fluid exiting the choke assembly located but not shown in 140 and dump the displacement fluid into the air chamber 180 which serves as a receptacle for the displacement fluid once it is ejected from the tubular section 121.

The slow and deliberate lateral movement of the piston 120 from left to right during the sample collection process, as dictated by the controlled movement of the displacement fluid through its metering element, will eventually bring the piston in close proximity or direct contact with the element 140. In either event, when an adequate volume of sample has been collected, some additional feature, not discussed in great detail here, will cause the sample collection process to stop and the sample to lock in. Usually this will be accompanied by the release of the high pressure nitrogen marked as 150 and located in the tubular section 151 through some appropriate mechanism contained within the element 140 also not shown here for brevity and simplicity. The action of the high pressure nitrogen 150 released behind piston 120 will serve to push the piston against the collected sample and significantly increase the pressure on the sample.

With this understanding of the traditional or conventional sampler it is instructive to explore the shortcomings of this conventional design that prompt the development of the proposed improvement. The existing designs all require a displacement fluid, a metering device for controlling the movement of the displacement fluid, a dump chamber for the spent displacement fluid to be stored, and a very high pressure source of nitrogen, all of which collective combination requires a complex assembly, all of whose components must perform in precise fashion for the sampler to return a representative sample. This complexity adversely affects the reliability and dimensions of the sampler, while the presence of the high pressure nitrogen introduces an element of risk from a safety standpoint. For which reason there is need for some novel design that will perform this same crucial sample gathering and preservation function in a simpler and safer manner.

Figure 2A:
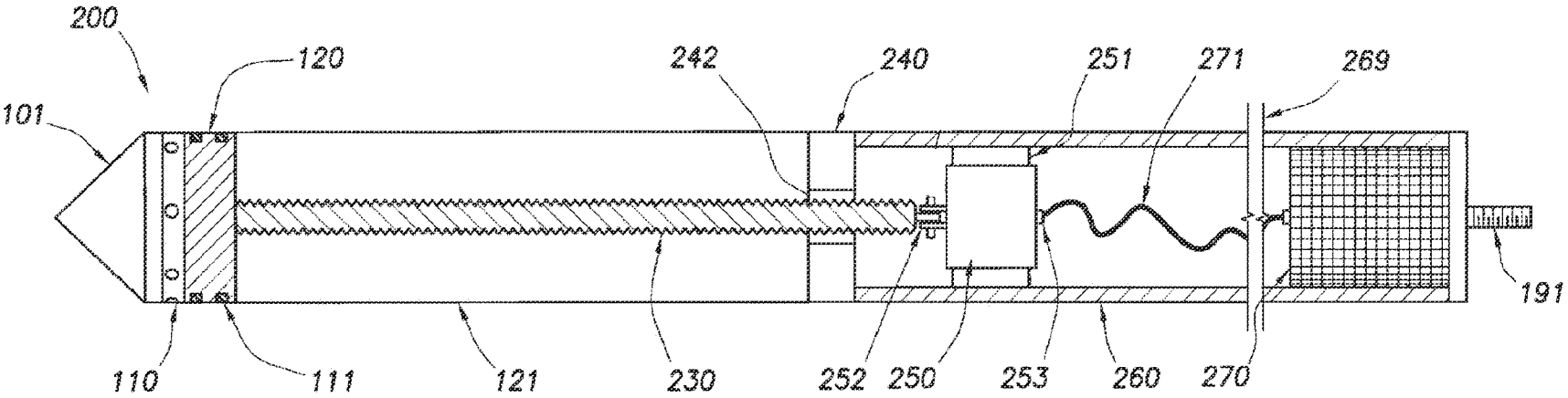
FIGS. 2A and 2B are cross-sectional schematic illustrations of a novel sampler in accordance with an exemplary embodiment of the present disclosure. A principal embodiment of the invention, as shown in the figures, is the incorporation and integration of a controllable electrical motor into the sampler design which can be used to unique advantage to affect the physical state of the collected sample.

Consequently, without introducing any limitations on the scope of the invention, an embodiment of the invention is presented in FIG. 2A. In FIG. 2A is depicted a sampler operable to collect and preserve a representative sample of some subterranean fluid acquired from a zone of interest according to an embodiment of the present invention that is schematically illustrated and generally designated 200. The new design will still need some elements that are generic to any sampler, namely a tubular section 121, a trigger section shown as 101 together with entry ports shown as 110 and a sample piston shown as 120 with associated elastomer seals 111, but all the remaining features are completely unique to this new design. For example, the displacement fluid usually positioned behind the sample piston has now been replaced with the screw element 230. The screw element is a solid threaded rod firmly affixed in lateral movement to the underside of piston 120 such that piston 120 and screw 230 are compelled to move in tandem laterally but not rotationally. Essentially, screw 230 is free to rotate about its connecting point to piston 120 without imposing a significant rotational force on the piston. However, any lateral movement of the rod in either direction will take the piston with it.

Screw 230 is threaded through a mechanical linear actuator such as a ball screw identified by the numeral 242 which is centralized in and firmly affixed to a mounted retainer plate 240 such that any rotation of the screw will cause the screw to move laterally, either to the right or to the left relative to the rigid palate 240 containing the ball screw, with the actual direction of movement dictated by the respective direction of rotation of the threads on the screw and the direction in which the rod itself is rotated. Furthermore, the lateral distance the screw will move through s a single rotation will be dictated by the pitch of the threads, which is the number of threads per unit length of the rod 230. Thus, for example, and only by example without imposing any limitations, it is conceivable that in a specific arrangement a clockwise rotation of the screw will cause it to move from right to left through the bearing plate, and consequently also move the piston 120 from right to left in the tubular section 121. In like fashion, for the same arrangement, a counter-clockwise rotation of the screw will cause a lateral movement of the screw from left to right and accordingly move the piston 120 from left to right.

It is recognized that rotational directions such as clockwise and counter-clockwise and lateral directions such as from right to left and left to right are all relative and dependent on the perspective and position of the viewer relative to the device under discussion. For the purpose of this discussion only and without imposing any limitations, clockwise is the rotational direction described by the movement of the hands of a clock placed at the end of the tubular section under discussion and viewed from right to left on the page. Furthermore, the lateral directions right to left and left to right are exactly as would appear if the screw in question were moved laterally on the page in question.

With this in mind it should be easy for someone well versed in the art to recognize that at the start of the sampling step the piston 120 will be positioned at the top of its stroke (to the far left) as shown in FIG. 2A, such that there is no room for any surrounding fluid to accumulate in front of piston 120. Furthermore, the act of collecting a sample will require that, and only as an example, the screw be rotated counter-clockwise causing the screw and piston to move laterally from left to right thus opening up a space in front of the piston 120 such that the desired sample can enter and fill the space being formed identified by the numeral 515 in FIG. 5A. Furthermore, it should also be obvious that the rate at which the desired space will form will be completely dictated by the rate at which the piston 120 moves in the tubular piece 121, and as this is directly tied to the rate at which the screw 230 rotates, at a sufficiently slow rate of rotation of the screw a single phase sample can be collected that has not flashed to two phases because pressure equalization between the sample being collected and the surrounding fluid feeding the sample is maintained.

Following the same reasoning, once the screw with attached piston has reached the end of its stroke to the right so that the desired volume of sample has been collected, the simple expediency of reversing the rotation of the screw should result in the sample collecting phase to stop and a sample compression to commence. In this mode the screw/piston assembly can be used to exert additional pressure on the collected sample so that it stays single phase during the subsequent recovery step when sample shrinkage due to temperature drop can expect the pressure to fall.

It only remains then to define a mechanism whereby the screw can be made to turn in either desired direction. Without in any way limiting the scope of this invention, one convenient mechanism for achieving this objective is the incorporation of a reversible electric motor, shown as 250 in FIG. 2A, that is firmly affixed to the screw via the mechanism 252 such that a rotation of the motor in either direction will also serve to rotate the screw in the same direction. An electric motor is preferable because they are capable of quickly generating significant amounts of torque which would be needed to move the piston 120 to generate the significant overpressure that will be required for single phase sampling. As presented in FIG. 2A, electric motor 250, the main shaft of the motor is directly connected at 252 to the screw, but this need not be the case. Electric motor 250 could be a combination of electric motor and gear box such that the torque delivered by the drive shaft of the motor can be greatly increased through the working of the gearbox using appropriate gear ratios to deliver the required torque needed to move the piston 120 against significant sample pressure.

The electric motor containing console identified as 250 can also contain the electronic programmable controller, not shown separately, that will control the actions of the electric motor. Thus for example, and without in any way limiting the scope of the invention, certain functionalities can be programmed into the controller at the surface, or conveyed by some additional means from the surface to the controller at the appropriate time such that once activated the electric motor will initially work to exert a certain pressure on piston 120 such that it will not move irrespective of the external pressure exerted against it through the action of the fluid surrounding it via the openings 110. However, once a specified preset period of time elapses, again possibly set initially at the surface or conveyed by some additional means from the surface, and ranging anywhere from just a few hours to many hours, the electric motor will turn in such direction and at such controlled speed that the movement of piston 120 from left to right will allow a representative sample, be it single or multiphase, but preferably single phase, to be collected in the tubular element 121. Furthermore, once the piston has traversed a specified distance as dictated either by a number of rotations of the screw, or the activation of some switch by the moving piston 120 hitting against it, the electric motor will stop further rotation in the current direction and instead reverse direction to exert pressure against the collected sample, again in accordance with some specified instructions provided to the programmable controller.

Figure 2B:
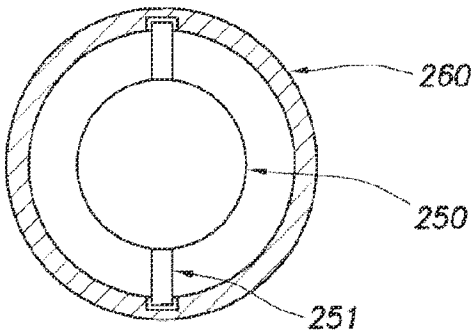

The electric motor is firmly encased in its external housing, collectively depicted in FIG. 2A as 250. The outside housing will have a plurality of protruding wings 251 not limited in number to 2 though only two are shown in the crosssectional FIG. 2B. These two wings will slide in appropriate grooves cut into the inside surface of the tubular section 260, again as shown in FIG. 2B. The intent of these grooves is to restrict the rotation of the housing of the electric motor under the force of the high torque that will be generated. Instead, the torque will be directly transmitted to the screw 230 causing the rotation and subsequent desired lateral movement of screw and co joined piston 120 as the screw rotates in the ball screw element 242.

Figure 3:
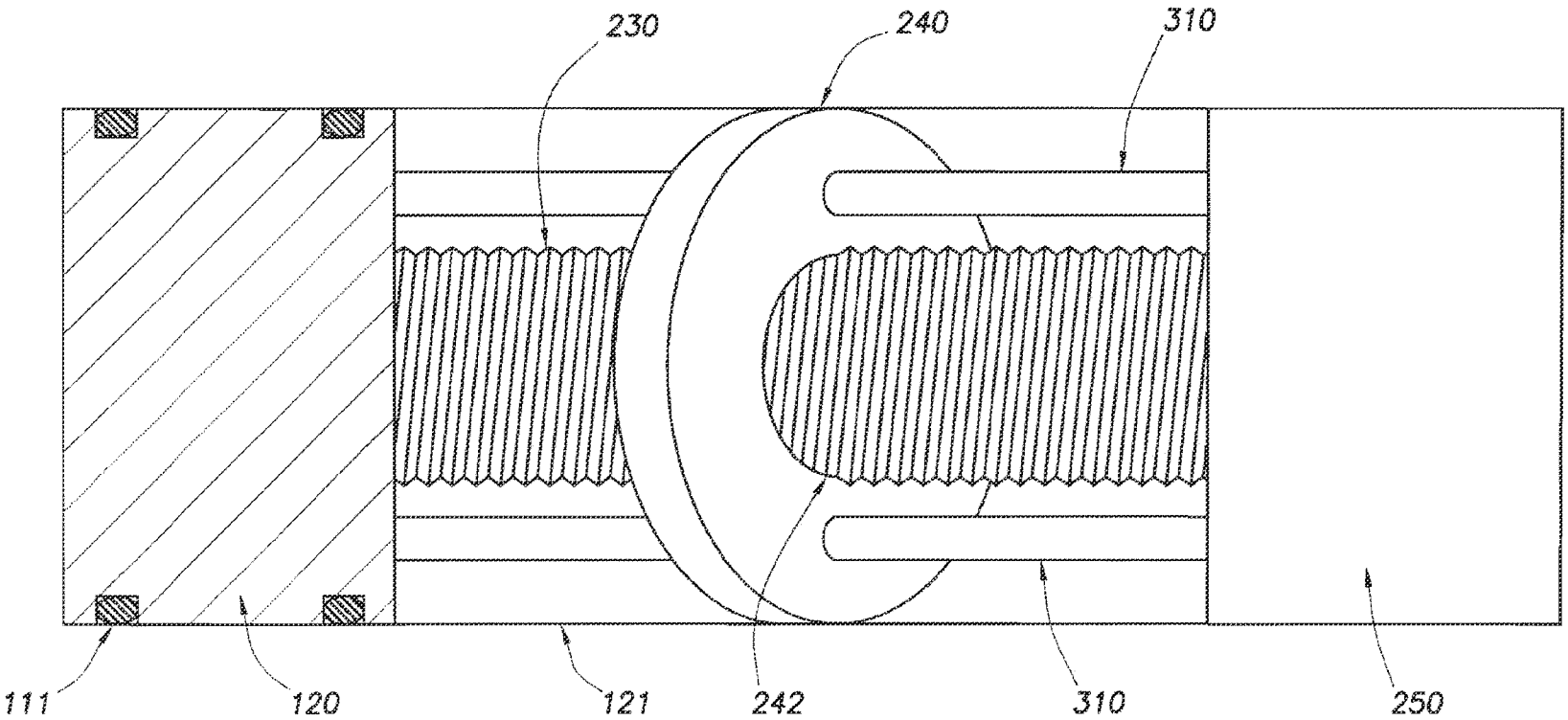
FIG. 3 is a cross-sectional depiction of a specific element of the novel sampler.

Another variation of this mechanism for restraining the rotation of the electrical motor is shown in FIG. 3. Instead of a multiplicity of wings contained in slots to retain the motor from turning (2 wings as shown in FIG. 2B), a plurality of rods identified as 310 attached to and extending all the way from the motor housing 250 through the rigid plate 240 containing the mechanical ball screw 242 and firmly affixed to the back face of the piston 120 are utilized. Because the rigid plate 240 is firmly affixed on its outside face to the inside face of either tubular element 121 or tubular element 260, the rotation of rigid plate 240 is eliminated. Consequently, by this mechanism the motor and piston are firmly affixed to each other and prevented from rotating because of the metal rods 310 traversing the rigid plate 240 even as the screw rotates and delivers the lateral movement of piston 120 and motor 250 to allow the sampler to perform its function. The advantage of such a design is that it allows for a larger diameter motor within the confines of the tubular section containing it, as no thickness is wasted in accommodating the wings as clearly observable in FIG. 3.

FIG. 3 shows a cross sectional view of the rigid plate 240 with the screw 230 penetrating the center and a plurality of sold rods 310, two shown as an example only, that will serve to keep the piston 120 aligned with the motor 250 such that they are rigidly affixed from rotating relative to each other. As a consequence of this restricted rotation the turning of the screw 230 will drive the piston 120 in the desired direction to achieve the desired sample collection and retention steps. It is understood that the rods 310 are of sufficient diameter to resist the torque action of the motor 250 as it turns the screw 230. Likewise, the rigid plate 240 will be of sufficient thickness to ensure that the entire assembly is maintained rigidly during the sampling operation. Fortunately the necessary calculations for defining the dimensions of the various components will be routine for any individual familiar with the mechanical design skills and familiar with the art associated with this technology.

In a slickline application, power for the electric motor will come from the power pack depicted in FIG. 2A by 270 and transmitted to the electrical motor via the electrical umbilical 271. The power pack in this instance could be a battery pack, rechargeable or otherwise, with the capacity to provide the needed electrical energy for the motor to perform its duty over the short number of days required for a typical sampling operation. In a wireline application the power pack may be dispensed with altogether and the necessary power provided by a surface source to the motor via the wireline. The same wireline can also be used to transmit the necessary instructions required by the electric motor to perform its sampling function. Understandably, in some applications it might be appropriate to have a combination of external power source and internal battery pack.

In a carrier based application, where a number of such samplers are simultaneously conveyed to a subterranean formation of interest on pipe or tubing, the power pack could be a much larger separate element carried as part of the carrier itself and used to provide power to a number of samplers. Clearly, and without in any way limiting the scope of this invention, the required power source can take numerous forms depending on the specific conveyance mechanism utilized for transporting the sampler to the vicinity of the desired subterranean zone to be sampled. Once again, the end piece of the sampler designated by 191 is just an ordinary mechanical connector for attaching a sampler to an adjoining sampler or to any appropriate conveyance mechanism such as slickline, wireline, coiled tubing, pipe, tubing, etc.

Figure 5A:
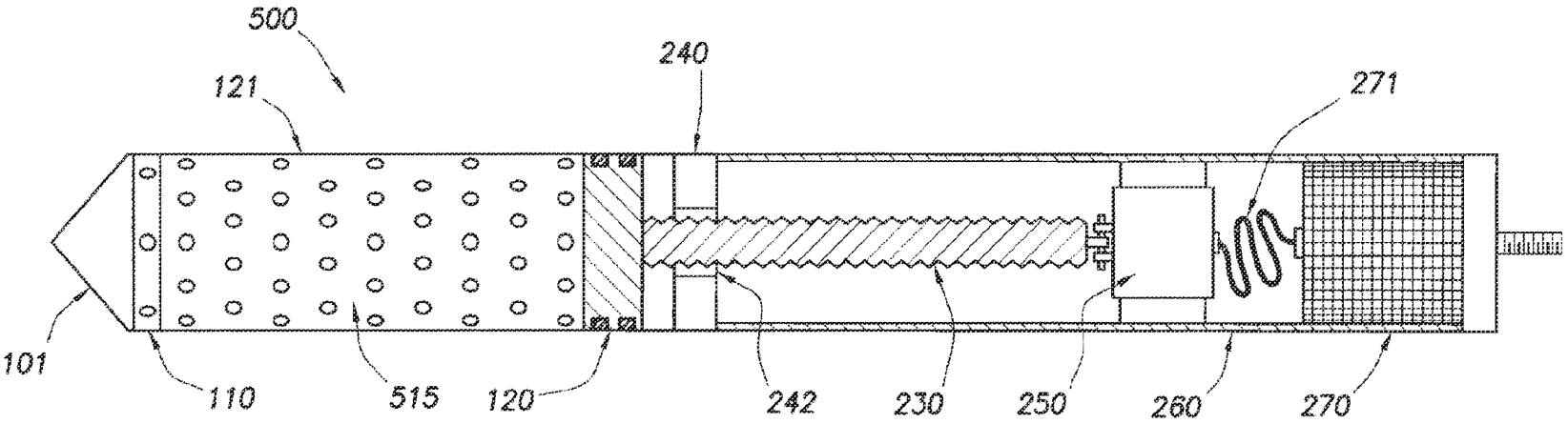
FIGS. 5A and 5B are cross-sectional schematic illustrations of an element of a novel sampler in accordance with an exemplary embodiment of the present disclosure.

FIG. 5A compliments FIG. 2A in the sense that whereas FIG. 2A portrays the sampler at the start of the sampling operation, namely either at the surface just prior to deployment downhole, or during deployment downhole, or even downhole and adjacent to the zone of interest just prior to a sample being collected, FIG. 5A depicts the internal configuration of the sampler after the sampling step has been concluded and the sample has been locked in place in the sampler. Consequently, the piston 120 has now moved from its initial position abutting the openings 110 to its new position abutting the rigid plate 240 containing the ball screw, thus allowing the controlled collection of a representative sample identified by the number 515 (FIG. 5A) in tubular 121. The actual final movement of the piston could be curtailed by a number of mechanisms, including but not limited to a counter that counts the number of turns the electric motor makes, or the number of rotations made by the screw shaft, or a linear transducer that detects the distance the piston has moved, or even some simple mechanical switch affixed to the top face of element 240 such that the lateral movement of piston 120 bringing it in contact with the switch activates the switch and stops further rotation of the electrical motor, or even any number of combinations of the above mentioned mechanisms.

Figure 4A:
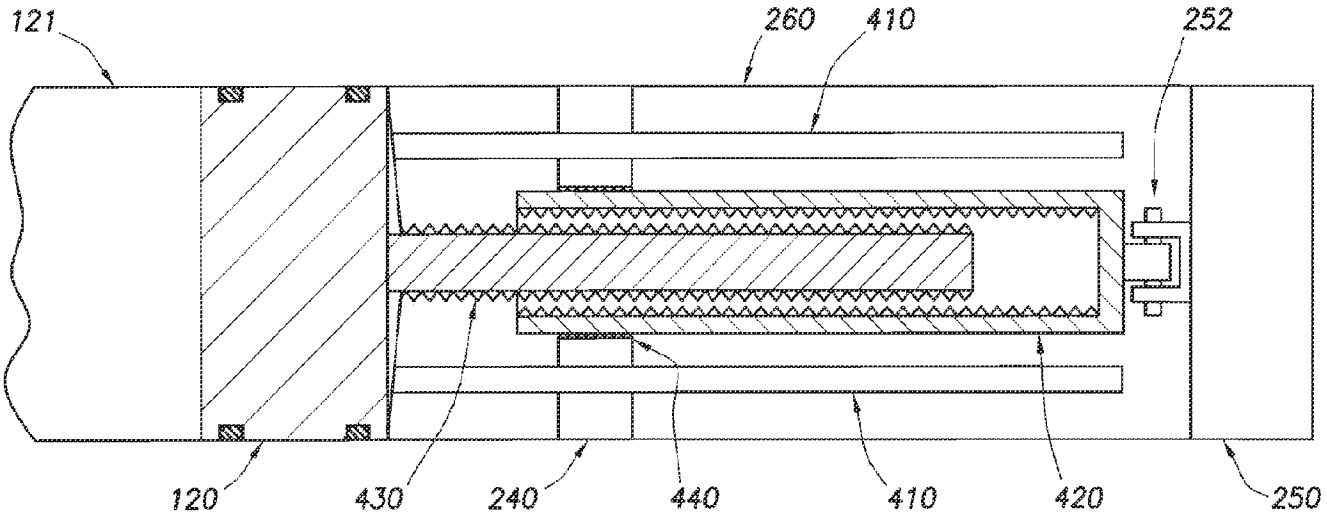
FIGS. 4A and 4B are cross-sectional schematic illustrations of a novel sampler in accordance with an exemplary embodiment of the present disclosure. The exemplary embodiment depicts a variation of the versatile design presented above, and as such represents another embodiment of the proposed invention.

FIG. 4A presents yet another embodiment of the present invention. As an example only, in this configuration the motor is held rigid while a series of rotational and mechanical devices like screws and sleeves are used to convert the rotational motion of the motor into translational motion of the piston 120. Consequently, this embodiment will also call for a tubular section 121 containing a piston 120 attached in mechanical continuity to a motor 250. The rotating shaft of the electrical motor is mechanically and firmly connected to a sleeve 420 such that the rotation of the motor will cause the sleeve 420 to also rotate. The inside face of the sleeve 420 is threaded with a screw thread that accommodates a screw 430 with identical threads as the sleeve such that any rotation of the sleeve 420 results in a likewise rotational motion of the internal screw 430. Additionally, the outside sleeve 420 is firmly and rigidly centralized and stabilized in the space surrounding it created by the tubular section 260 by virtue of the rigid support 240 with a centralized ball bearing 440 which allows free rotation of the sleeve 420 as the motor turns.

The screw 430 has two ends, one of which is unattached and moves freely in the sleeve 420. The other end is firmly attached to the piston 120 so that any rotational or lateral movement of the screw is translated to a similar movement of the piston. It follows then that as the motor 250 turns the sleeve 420, and depending on the resistance faced by the piston 120, the internal screw 430 will also turn and correspondingly turn the piston with it. However, if the piston could be restricted from rotating, then the rotation of the sleeve 420 would force a lateral movement of the screw in or out of the sleeve surrounding it, and a corresponding movement of the piston such as to compress or release pressure on a fluid contained in front of it.

Figure 4B:
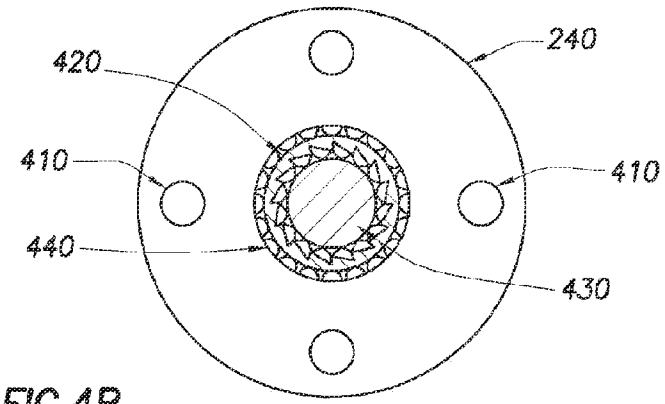

The piston 120 is stopped from rotating in the tubular 121 by means of a plurality of solid rod elements 410(four shown in FIG. 4B) that are firmly attached to the piston and also pass through the rigid plate 240 which has the necessary appropriately placed passages to accommodate the solid rods. With the plurality of rods in place the piston 120 cannot rotate, and consequently, any rotational movement of the sleeve 420 will cause a lateral movement of the screw 430, and an accompanying lateral movement of the piston 120. Consequently, and without in any way limiting the scope of the invention, a method is presented whereby the motor is held rigid while tubular and screw sections are used to translate the rotation of the motor to a lateral movement of the piston.

These embodiments are not meant in any way to limit the scope of the invention, as one versed in the art and with the benefit of this disclosure could easily describe some other combination of features that could deliver the same result. For example the working piston 120 could actually be the leading edge of a large syringe with internal female threads, while the motor turns a screw that engages the internal threads. If the syringe element is further restricted from rotating using a mechanism such as discussed earlier, or some other equivalent mechanism, then the same desired movement of the piston is achieved.

Moreover, it is recognized that either method is equally relevant, so that whether the motor and piston are mechanically connected and move in tandem, or are uncoupled through some auxiliary agency so that only the piston moves as the motor turns, the end result is still the same. Consequently, the remaining embodiments presented herein are recognized as being equally applicable to either feature even if both mechanisms are not explicitly referred to.

Furthermore, because of the high temperature environment the motor and electronics will be exposed to, in addition to the heat the motor and electronics will generate when called upon to perform their functions, it might be advantageous to improve the heat transfer characteristics of the motor. This can be most conveniently achieved by immersing the motor and its ancillary electronics in a medium that is electrically non-conducting, most conveniently a dielectric fluid. Because the surrounding fluid is electrically non-conducting, the working of the motor will in no way be affected. This is a relatively routine practice for downhole tools and will not be discussed in greater detail here. Suffice it to say that the performance and longevity of the motor can be considerably enhanced by improving its ability to dissipate heat, a step most easily accomplished by immersing the motor and associated electronics in a dielectric fluid.

FIG. 5A presents an embodiment of the sampler showing the configuration of the sampler after a sample has been successfully collected. It should be clear from viewing FIG. 5A that the electric motor 250 has made a similar lateral transition in accompaniment to the piston 120 and is now located much closer to the power pack 270 compared to its position at the start of the sampling operation. In this configuration, with the sample collection step completed, the sample is now ready to be maintained and recovered in a representative state, which process requires that the electrical motor reverse direction and cause the screw to rotate such that screw and piston move from right to left to exert pressure on the sample. The exact pressure at which the sample will be maintained during recovery will be dictated by known parameters of the reservoir that is being sampled and the desired degree of safe pressure above the reservoir pressure that is required by that particular set of circumstance.

Figure 5B:
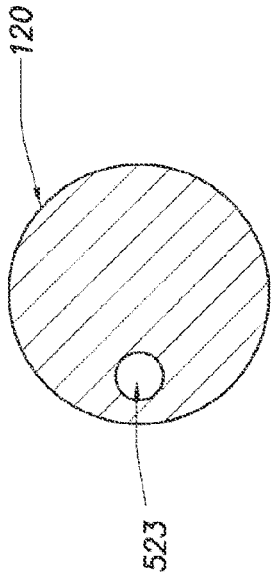

In FIG. 5B is depicted a top view of piston 120, namely a view of the face of the piston against which the sample will collect as the piston moves laterally from left to right during the sample gathering step. Shown without elaboration on the top face of the piston is the component 523 which is a pressure transducer. The pressure transducer 523 will serve to measure and convey the pressure of the sample to the electronic controller associated with the motor, which in turn will control the movement of the electric motor and the attached screw and piston such that some pre-set value of pressure is maintained during the entire sampling and recovery cycle. For example, prior to sampling commencing as shown in FIG. 2A, the piston might be kept static due to the absence of any input received by the electric motor to move in either direction. Subsequently, at the start of sampling the electric motor can be activated to reverse direction at some fixed slow speed such that a representative sample is collected in the space 515. Once the sample has collected and piston movement from left to right is halted, the electric motor can be activated to reverse direction and pressurize the sample for single phase recovery.

The choice of pressure at which the sample is maintained as single phase is case specific, but as a rule should always be at least 2000 psi above the pressure at which the sample is collected. Consequently, if a prior knowledge of the reservoir pressure is available, the electronic controlling unit can be pre-programmed to keep the collected sample at some pressure that is at least 2000 psi above this value. On the other hand, the electronic programmable controller can be set to always keep the pressure at least 2000 psi above the initially registered sample pressure recorded at the end of the sampling step. This remarkable flexibility for pressure maintenance is unique to this design and is another significant distinguishing feature that demarcates this design from those that have preceded it.

The pressure transducer needed for this application is quite commonplace in the industry, with any number of variations fit for purpose readily available, so that a lack of elaboration of its exact features and mechanism does not in any way detract from the scope of this invention. Though not shown, it is further understood that the pressure information measured by the pressure transducer 523 will be conveyed to the electrical programmable control unit either directly by means of an electrical cable, or by some other means including but not limited to acoustic or electro-magnetic means, including a radio or optical signal.

As indicated earlier, a gas tends to be more compressible than a liquid, and this increased compressibility imparts a 'sponginess' to the collected sample so that a gas sample is less prone to the large pressure variations that might accompany a small change of temperature of a collected liquid sample. This 'sponginess' has a forgiving element to it that places less of a demand on the performance of the electric motor in meeting the requirements of single phase sampling. Without placing any limitations on the scope of the disclosure, consider the case where it is determined to maintain the post sampling recovery pressure at 10,000 psi. In actuality it could prove exceedingly difficult to preserve the sample at exactly 10,000 psi, but rather some small range in pressure say +or −20 psi on either side of 10,000 psi will prevail so that the range of pressures over which the sample can be maintained will actually be 10,020 psi on the high side and 9980 psi on the low side. In instances where a liquid sample is collected, a very small change in temperature could cause a quick loss or gain of 20 psi and require the electrical motor to compensate. Likewise, a small change in the piston position due to the action of the motor could cause a rapid rise in the pressure of the sample causing it to exceed the desirable upper limit of 10,020 psi and requiring the motor to compensate and bring the pressure back into an acceptable range. Clearly, there is advantage to making the sampling system appear to be compressible irrespective of the nature of sample collected.

Figure 6A:
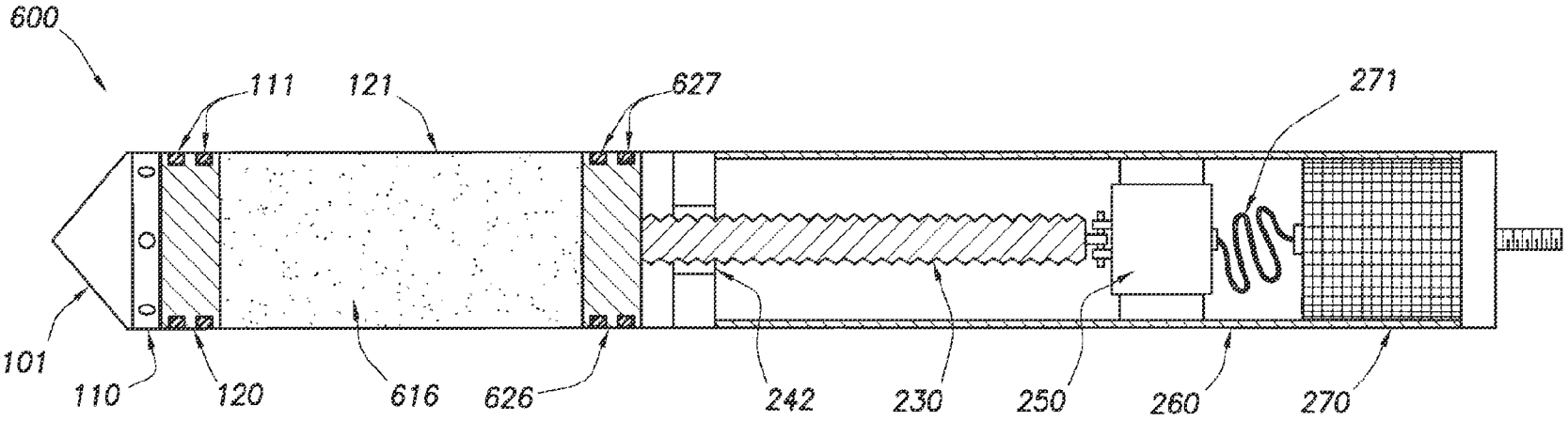
FIGS. 6A and 6B are cross-sectional schematic illustrations of a novel sampler in accordance with an exemplary embodiment of the present disclosure. The exemplary embodiment depicts a variation of the versatile design presented above, and as such represents another embodiment of the proposed invention. By incorporating a second piston and a high pressure nitrogen charge between the two pistons, the highly compressible feature of nitrogen can be exploited to moderate the dramatic pressure swings that could attend the behavior of a less compressible liquid sample.
Figure 6B:
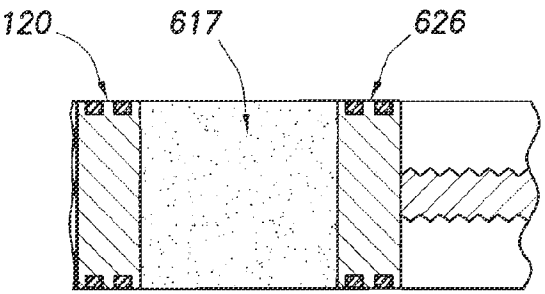

FIG. 6A presents an embodiment of the present invention wherein a feature is introduced that allows the sample to artificially indeed have a high measure of compressibility irrespective of the compressibility of the collected sample. This new feature is represented by two separate and distinct pistons identified as 120 and 626 between which a neutral, non-reactive gas like nitrogen, indicated as 616 can be placed. Piston 120 is still the primary piston to the left of which the sample will collect. However, the screw element 230 is no longer attached to piston 120 but instead is connected to the second piston 626. FIG. 6A depicts the starting position of the sampler at the surface before the sampler is attached to the conveyance devise for transportation to the zone of interest for sampling. Initially, with the pistons as far apart as necessary, the space between them is filled with some non-reactive neutral gas shown as 616, preferably but not limited to nitrogen, and at some pressure appropriate to the anticipated sampling opportunity. For this application, the pressure transducer shown as 523 in FIG. 5B but not shown in FIG. 6A will now be located on the top or left facing face of piston 626, namely the face of the piston 626 abutting the inert gas charge identified as 616. Because the nitrogen charge 616 is in hydraulic communication with the collected sample, the working of the sampler is not in any way adversely affected by this inclusion, because once the sampling process commences, the pressure of the encased and isolated non-reacting gas charge 616 will identically match that of the sample itself being collected to the left of piston 120.

Even though the pistons, the non-reactive gas charge, and the sample being collected are in hydraulic communication, cross contamination of the sample with the inert gas is prevented by the presence of the elastomeric seals shown as 111 in FIG. 6A. A similar set of seals associated with piston 626 and indicated as 627 helps to retain the non-reacting gas charge trapped between the two pistons even as the pressure of the non-reacting gas is raised significantly as part of the sampling program.

In order to maximize the opportunities for such a sampling device across the full range of potential reservoirs it might encounter, it is expected that it will have a pressure rating of up to say 40,000 psi, though more likely this pressure rating will be in the 20,000 psi range. This pressure rating implies that the sampler can be immersed in an environment where the surrounding fluids are at a pressure of up to 20,000 psi or 40,000 psi without the sampler suffering any mechanical failure.

The physical dimensions of the sampler may vary significantly depending on the particular application, especially as dictated by the carrier the sampler is positioned in for conveyance to a reservoir of interest. In such instances where a carrier is in use for conveying the samplers, the diameter of the sampler might vary anywhere from one inch to as much as three inches or more. However, for slickline or wireline applications the dimensions of the surface lubricator which is to be used to introduce the sampler into the well bore, as also the internal diameter of the elements of the tool string the sampler will need to traverse, tends to be the limiting factor. In such cases the diameter will tend to be more in the range of 2 inches with an overall length of 17 feet. However, it needs to be kept in mind that these dimensions are merely suggestions dictated by specific operations and could vary significantly as the opportunity and the means for conveyance change.

The power required to run the motor will also be a significant consideration in the dimensions and performance of the sampler. Thus, in a slickline application the power will need to be provided by battery cells appropriately designed and sized for this application. However, these battery components are commercially readily available and do not need to be elaborated on here. In a wireline or e-line application all the power needed for the operation of the sampler will be delivered by the wireline itself, resulting in a much simpler and shorter sampler with an extended functional life downhole. In carrier based operations the battery pack could be incorporated with the sampler itself or could be a larger and separate battery pack designed to accommodate a larger number of samplers for extended working life downhole.

It should be obvious to one skilled in the art and enlightened by the teachings of this disclosure that the sample size collected can be varied significantly and be influenced by the needs of a particular application or situation. The conventional sampler can collect a sample volume anywhere from 5 cc to 5000 cc as dictated by circumstance, need, opportunity, and design. However, the unique features of the disclosed design attending the present invention results in the elimination of a significant amount of overall sampler volume and length. This eliminated volume and length can be exploited in the present design to deliver a much larger volume of captured sample. However, in the cause of flexibility and redundancy it might prove advantageous to collect multiple samples rather than a single large sample. This is facilitated in the present design such that two or even three separate and distinct sample volumes via distinct and separate samplers might be collected in the same overall dimensions as would deliver only a single sample volume in the more traditional design. Accordingly, the sample volume can range anywhere from 5 cc to in excess of 10,000 cc depending on a particular application without departing from the spirit of this invention.

While this invention has been described with reference to numerous embodiments, this description is not intended to be construed in a limiting sense. Instead it is expected that the discussed embodiments would serve to demonstrate the versatile ability of the proposed sampler design to accommodate the capture and representative preservation of single and complex multiphase streams of variable ratios and flow rates of the various components that can be encountered during a well test operation. Understandably, various modifications and combinations of the illustrative embodiments as well as other embodiments of the invention will be apparent to persons skilled in the art upon reference to the description. It is, therefore, intended that the appended claims encompass any such modifications or embodiments.

What is claimed is:

1. An apparatus for sampling a subterranean reservoir fluid in a wellbore, the apparatus comprising:

a. a fluid inlet port for accessing the subterranean reservoir fluid;

b. a tubular portion;

c. a piston sealably and movably disposed within the tubular portion, wherein one or more surfaces of the piston and the tubular portion in conjunction with the fluid inlet port, at least in part, define a sample collection space;

d. a motor within the tubular portion, wherein the motor is mechanically coupled to the piston;

e. multiple slideable wings protruding from the motor;

f. slots within the internal surface of the tubular portion and sized for the protruding slideable wings to slide within them;

g. a screw connected at one end to the motor and at the other end to the piston;

h. a mechanical linear actuator through which the screw passes, wherein the mechanical linear actuator is affixed to a plate retained in the tubular portion; and i. a connector for conveying the apparatus to a desired subterranean location.

2. The apparatus of claim 1, further comprising a power source in the tubular portion.

3. The apparatus of claim 2, wherein the power source is a battery pack.

4. The apparatus of claim 1, further comprising an electronic programmable controller within the tubular portion.

5. The apparatus of claim 1, further comprising a trigger for opening the fluid inlet port for accessing the sample of subterranean reservoir fluid and another trigger for closing the fluid inlet port after accessing the sample of subterranean reservoir fluid.

6. The apparatus of claim 1, further comprising a gearbox in the tubular portion for magnifying torque generated by the motor.

7. The apparatus of claim 6, wherein the motor, gear box and piston are mechanically connected so that the motor and the piston move together in tandem.

8. An apparatus for sampling a subterranean reservoir fluid, the apparatus comprising:

a. a fluid inlet port;

b. a tubular portion;

c. a piston sealably and movably disposed within the tubular portion, wherein one or more surfaces of the piston and the tubular portion in conjunction with the fluid inlet port, at least in part, define a sample collection space;

d. an assembly within the tubular portion comprising a motor and a set of gears for magnifying torque generated by the motor;

e. a screw connected at one end to a piston the motor and at the other end to the piston;

f. a linear actuator through which the screw passes wherein the linear actuator outer surface of the plate is affixed to a plate retained in the tubular portion;

g. a plurality of rods attached to and extending from the motor through the plate and at the other end to the piston; and wherein the motor, set of gears, and piston are mechanically connected so that the motor and the piston move together in tandem.

9. The apparatus of claim 8, further comprising a power source in the tubular portion.

10. The apparatus of claim 8, further comprising an electronic programmable controller within the tubular portion.

11. The apparatus of claim 8, further comprising a trigger for opening the fluid inlet port for accessing the sample of subterranean reservoir fluid and another trigger for closing the fluid inlet port after accessing the sample of subterranean reservoir fluid.

12. The apparatus of claim 9, wherein the power source is a battery pack.

* * * * *